US006351544B1

(12) United States Patent
Noll

(10) Patent No.: US 6,351,544 B1
(45) Date of Patent: Feb. 26, 2002

(54) REGRESSIVELY HINGED SPIDER

(75) Inventor: Michael A. Noll, Nashville, IN (US)

(73) Assignee: Harman International Industries Incorporated, Northridge, CA (US)

( * ) Notice: Subject to any disclaimer, the term of this patent is extended or adjusted under 35 U.S.C. 154(b) by 0 days.

(21) Appl. No.: 09/458,930

(22) Filed: Dec. 10, 1999

(51) Int. Cl.[7] ..... H04R 25/00
(52) U.S. Cl. ..... 381/404; 381/398; 381/403
(58) Field of Search ..... 381/396, 398, 381/403, 404, FOR 157; 181/171, 172

(56) References Cited

U.S. PATENT DOCUMENTS

| | | | | |
|---|---|---|---|---|
| 2,201,059 | A | | 5/1940 | Stephan |
| 2,295,483 | A | | 9/1942 | Knowles |
| 2,490,466 | A | | 12/1949 | Olson et al. |
| 2,922,850 | A | * | 1/1960 | Zuerker ..... 381/404 |
| 2,998,496 | A | | 8/1961 | Hassan |
| 3,095,941 | A | | 7/1963 | Hassan |
| 3,544,720 | A | | 12/1970 | Corderman |
| 3,612,783 | A | | 10/1971 | Schneider |
| 3,645,356 | A | | 2/1972 | Sotome |
| 3,780,232 | A | | 12/1973 | Ward |
| 3,834,486 | A | | 9/1974 | Tsuge et al. |
| 3,858,680 | A | | 1/1975 | Tsuge et al. |
| 3,925,626 | A | | 12/1975 | Stallings, Jr. |
| 3,925,708 | A | | 12/1975 | Picciochi |
| 3,930,129 | A | | 12/1975 | Cohen et al. |
| 3,946,832 | A | | 3/1976 | Takano et al. |
| 3,959,736 | A | | 5/1976 | GrosJean |
| 3,997,023 | A | | 12/1976 | White |
| 4,071,111 | A | | 1/1978 | Croup |
| 4,140,203 | A | | 2/1979 | Niguchi et al. |
| 4,146,756 | A | | 3/1979 | Kito et al. |
| 4,478,309 | A | | 10/1984 | Kawamura et al. |
| 4,531,025 | A | * | 7/1985 | Danley et al. ..... 381/404 |
| 5,008,945 | A | | 4/1991 | Murayama et al. |
| 5,224,169 | A | | 6/1993 | Morris, Jr. et al. |
| 5,293,009 | A | | 3/1994 | Fleischer |
| 5,319,718 | A | | 6/1994 | Yocum |
| 5,323,469 | A | | 6/1994 | Scholz |
| 5,371,805 | A | | 12/1994 | Saiki et al. |
| 5,650,105 | A | | 7/1997 | Yocum |
| 5,715,324 | A | | 2/1998 | Tanabe et al. |
| 5,729,616 | A | | 3/1998 | Geisenberger |
| 5,734,734 | A | | 3/1998 | Proni |
| 5,802,195 | A | | 9/1998 | Regan et al. |
| 5,838,809 | A | | 11/1998 | Sato et al. |
| 5,847,610 | A | | 12/1998 | Fujita |

FOREIGN PATENT DOCUMENTS

| | | |
|---|---|---|
| DE | 40 07 657 | 12/1990 |
| EP | 10322795 | 12/1998 |
| JP | 10-322795 | 4/1998 |
| NL | 8204348 | 3/1983 |

* cited by examiner

*Primary Examiner*—Sinh Tran
(74) *Attorney, Agent, or Firm*—Barnes & Thornburg

(57) ABSTRACT

An electrodynamic transducer includes a frame, a magnet assembly providing a magnetic field across an air gap, a voice coil, a coil former for supporting the voice coil in the air gap, a diaphragm having an outer perimeter and an apex, and a surround coupled to the outer perimeter and the frame to support the outer perimeter from the frame. The coil former is coupled to the apex so that current through the voice coil causing the voice coil to move in the air gap causes the diaphragm to move. The spider has convolutions radially outward from the coil former. The surround may also have convolutions radially outward from the outer perimeter. The convolutions include truncated arcs.

16 Claims, 3 Drawing Sheets

FIG. 2
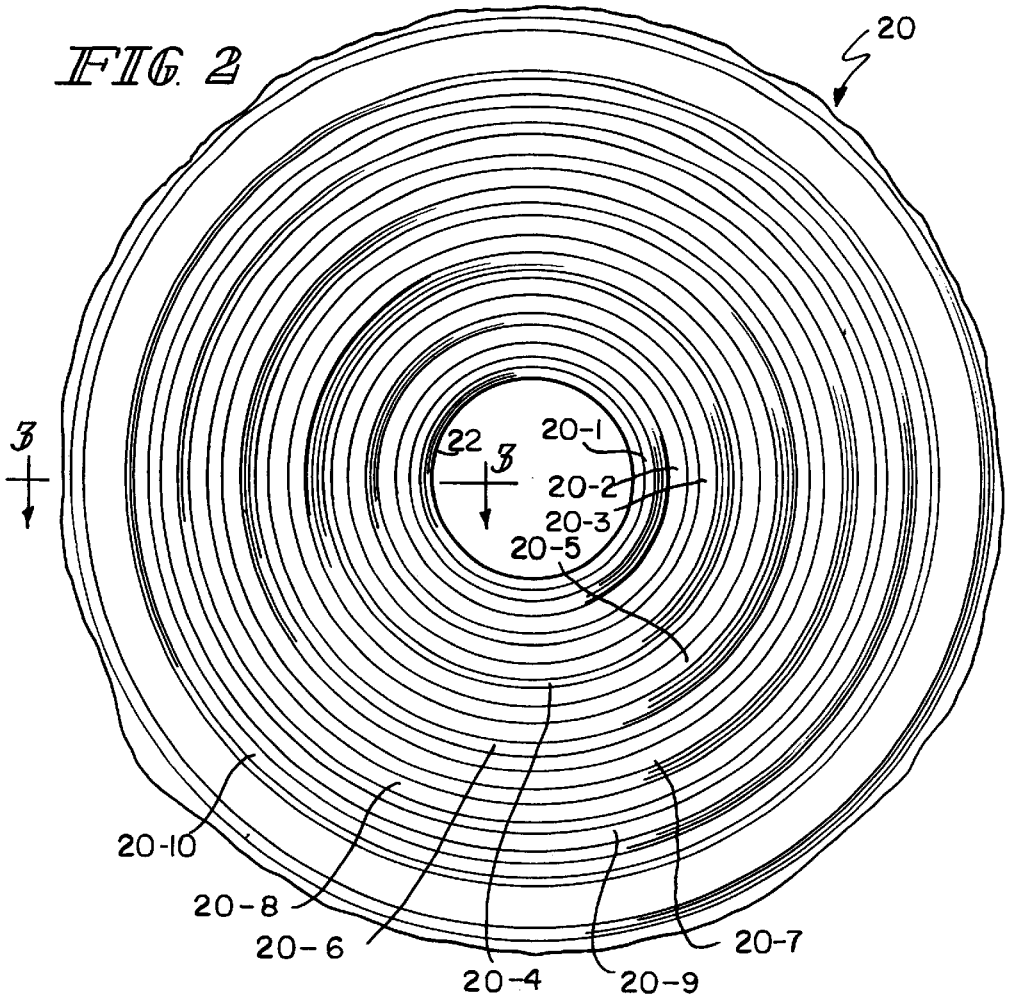
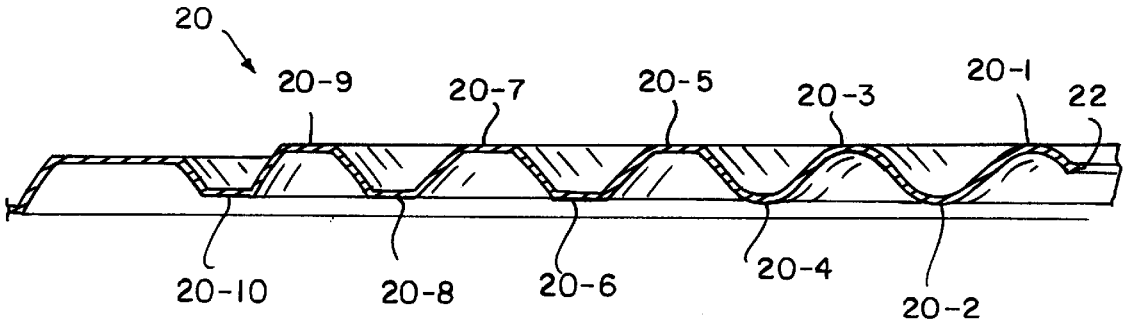
FIG. 3

REGRESSIVELY HINGED SPIDER

FIELD OF THE INVENTION

This invention relates to electrodynamic transducers. It is disclosed in the context of a moving coil loudspeaker, but is believed to have utility in other applications as well.

BACKGROUND OF THE INVENTION

A number of different loudspeaker constructions involving a number of different types of suspensions are known. There are, for example, the loudspeakers illustrated and described in the following U.S. Pat. Nos. 2,201,059; 2,295,483; 3,930,129; 4,146,756; 5,715,324; and, 5,729,616. This listing is not intended as a representation that a thorough search of the prior art has been conducted or that no more pertinent art than that listed above exists, and no such representation should be inferred.

A loudspeaker has a fairly limited range of approximately linear motion of its voice coil, diaphragm and other moving parts including the suspension components for the voice coil and diaphragm. Nonlinearity increases gradually as the diaphragm excursion increases up to a limit set by the geometry of the motor structure and/or the physical limitations set by the suspension components. The linearity, or nonlinearity, is often illustrated by a plot of force versus displacement. From the force versus displacement function or curve, the maxima of substantially linear movement can be ascertained. This is what is generally referred to as the "flat" region of the force versus displacement curve. When the loudspeaker is driven beyond this region, it does not transduce the input current to sound faithfully. This inaccuracy is frequently referred to as harmonic distortion. In the past, to reduce harmonic distortion, the roll height, the depth of the convolutions of the suspension spider and cone surround, was increased. However, increasing the roll height can lead to "oil canning," the inversion of one or more rolls, which causes a discernible "pop" when the inverted roll(s) revert(s) to substantially its (their) designed orientation(s). Increasing the roll height also reduces the lateral stability of the moving mechanism of the loudspeaker, which may result, for example, in side-to-side movement of the voice coil in the air gap with its attendant consequences.

DISCLOSURE OF THE INVENTION

According to one aspect of the invention, an electrodynamic transducer includes a frame, a magnet assembly providing a magnetic field across an air gap, a voice coil, a coil former for supporting the voice coil in the air gap, a diaphragm having an outer perimeter and an apex, and a surround coupled to the outer perimeter and the frame to support the outer perimeter from the frame. The coil former is coupled to the apex so that current through the voice coil causing the voice coil to move in the air gap causes the diaphragm to move. The surround has convolutions radially outward from the outer perimeter. The convolutions include truncated arcs.

Illustratively according to this aspect of the invention, the convolutions also include generally straight sections extending between adjacent truncated arcs.

Further illustratively according to this aspect of the invention, the depth of the truncations is non-uniform with increasing distance from the outer perimeter.

Additionally illustratively according to this aspect of the invention, the depth of the truncations increases with increasing distance from the outer perimeter.

Alternatively illustratively according to this aspect of the invention, the depth of the truncations varies quasi-randomly with increasing distance from the outer perimeter.

According to another aspect of the invention, an electrodynamic transducer includes a magnet assembly providing a magnetic field across an air gap, a voice coil, a coil former for supporting the voice coil in the air gap, a diaphragm having an apex, and a spider coupled to the coil former to support the voice coil in the air gap. The coil former is coupled to the apex so that current through the voice coil causing the voice coil to move in the air gap causes the diaphragm to move. The spider has convolutions radially outward from the coil former. The convolutions include truncated arcs.

Illustratively according to this aspect of the invention, the convolutions also include generally straight sections extending between adjacent truncated arcs.

Further illustratively according to this aspect of the invention, the depth of the truncations is non-uniform with increasing distance from the coil former.

Additionally illustratively according to this aspect of the invention, the depth of the truncations increases with increasing distance from the coil former.

Alternatively illustratively according to this aspect of the invention, the depth of the truncations varies quasi-randomly with increasing distance from the coil former.

BRIEF DESCRIPTION OF THE DRAWINGS

The invention may best be understood by referring to the following detailed description and accompanying drawings which illustrate the invention. In the drawings:

FIG. 2 illustrates an enlarged view of a detail of the loudspeaker illustrated in FIG. 1, taken generally along section lines 2—2 of FIG. 1;

FIG. 3 illustrates a further enlarged sectional view of the detail illustrated in FIG. 2, taken generally along section lines 3—3 of FIG. 2; and, FIG. 4 illustrates an enlarged detail of a fragmentary cross-section through another loudspeaker constructed according to the invention.

DETAILED DESCRIPTIONS OF ILLUSTRATIVE EMBODIMENTS

Figure 1:
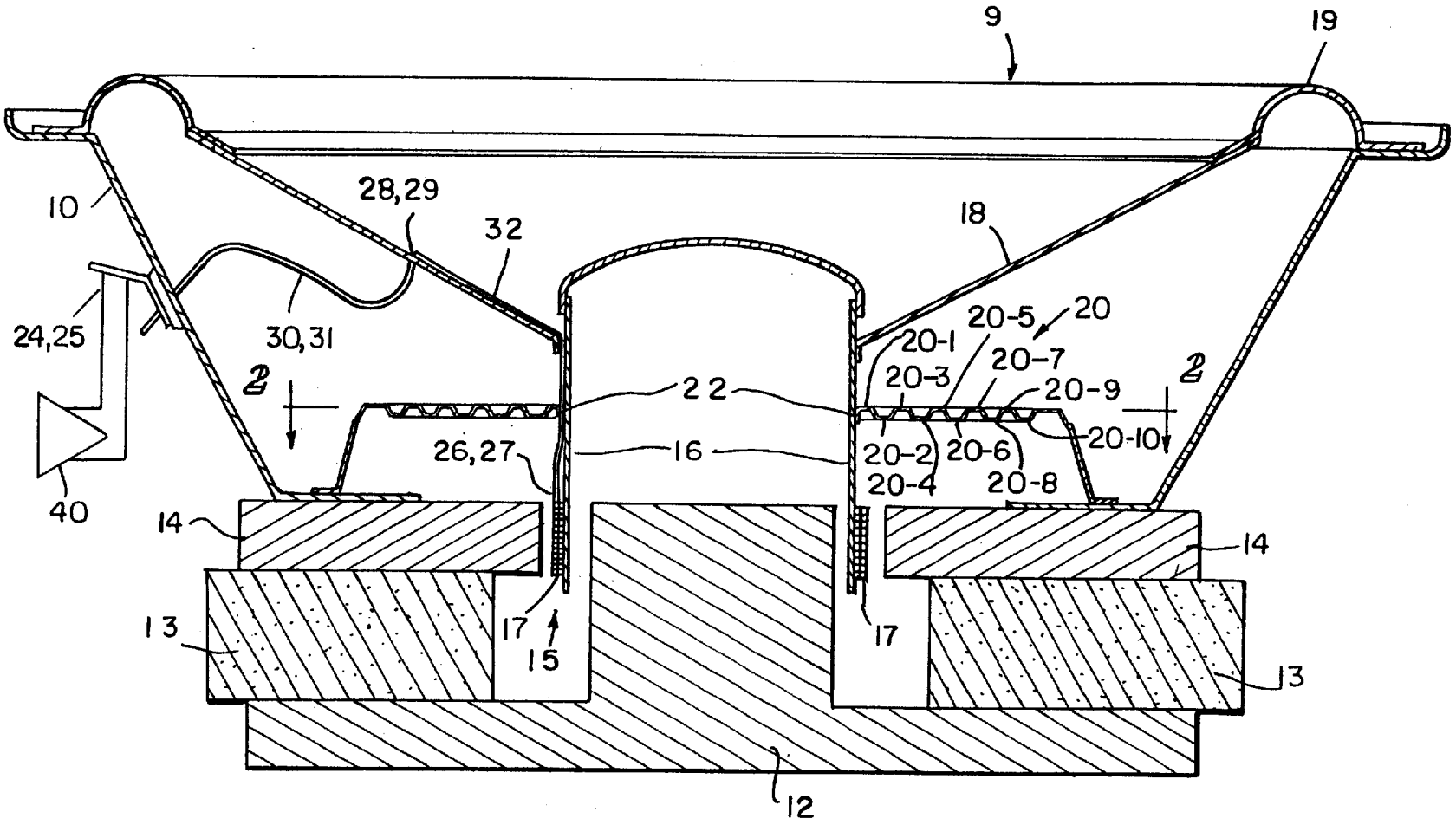
FIG. 1 illustrates a fragmentary cross-section through a loudspeaker constructed according to the invention.

Referring now to FIGS. 1–3, a loudspeaker 9 includes a supporting frame 10 and a motor assembly. The illustrated motor assembly includes a backplate/center pole 12, a permanent magnet 13, and a front plate 14 providing a substantially uniform magnetic field across an air gap 15. A voice coil former 16 supports a voice coil 17 in the magnetic field. Current from an amplifier 40 related to the program material to be transduced by the loudspeaker 9 drives the voice coil 17, causing it to reciprocate axially in the air gap 15 in a known manner. A cone 18 attached at its apex to an end of the coil former 16 lying outside the motor assembly 12, 13, 14 is coupled by a surround 19 at its outer perimeter to the frame 10. A spider 20 is coupled at its outer perimeter to the frame 10. The spider 20 includes a central opening 22 to which the voice coil former 16 is attached. The suspension including the surround 19 and spider 20 constrains the voice coil 17 to reciprocate axially in the air gap 15.

A typical, although by no means the only, mechanism for completing the electrical connection between the loudspeaker terminals 24, 25 and the voice coil wires 26, 27 is illustrated in FIG. 1. The voice coil wires 26, 27 are dressed against the side of the coil former 16, and pass through central opening 22 and the intersection of the coil former 16 and the apex of the cone 18. Wires 26, 27 are then dressed across the face 32 of the cone 18 to the points 28, 29 on the face of the cone 18 where they are connected to the flexible conductors 30, 31. Connections 28, 29 are made by any of a number of available techniques. The coil wires 26, 27 illustratively are fixed to the face 32 of the cone 18 with (an) electrically non-conductive adhesive(s).

The spider 20 is regressively tapered from its inner convolution 20-1 toward its outer convolution 20-10. Convolution 20-1, which lies adjacent the coil former 16, is an arc of a circle having a radius of, for example, 1.8 mm. Convolutions 20-2–20-10 are arcs of circles having radii of, for example, 2 mm. However, outward from convolution 20-2, convolutions 20 are truncated. That is, the apex of each convolution from convolution 20-2 outward has a more or less flattened apex formed on it. The width of the flat increases with increasing radius from the centerline of the coil former 16. Illustratively, the flat at the apex of convolution 20-3 is 5 mm wide. The flat at the apex of convolution 20-4 is 1.0 mm wide. The flat at the apex of convolution 20-5 is 1.5 mm wide. The flat at the apex of convolution 20-6 is 1.5 mm wide. The flat at the apex of convolution 20-7 is 1.75 mm wide. The flat at the apex of convolution 20-8 is 1.75 mm wide. The flat at the apex of convolution 20-9 is 2.0 mm wide. Finally, the flat at the apex of convolution 20-10 is 2.0 mm wide.

The spider 20 of the invention may be used with a flat outer foot configuration where the spider 20 is coupled at its outer perimeter to the frame 10 and/or motor assembly 12, 13, 14, or with the illustrated cupped outer foot configuration where the spider 20 is coupled at its outer perimeter to the frame 10 and/or motor assembly 12, 13, 14. The spider 20 of the invention may be used with the illustrated "neck-down" attachment of the central opening 22 of spider 20 to the coil former 16 or with a "neck-up" attachment of the central opening 22 of spider 20 to the coil former 16. The spider 20's compliance is more linear over the full range of deflection of the spider 20 as the voice coil 17 moves in the air gap 15. Non-linear, or harmonic, distortion is thereby decreased.

Figure 4:
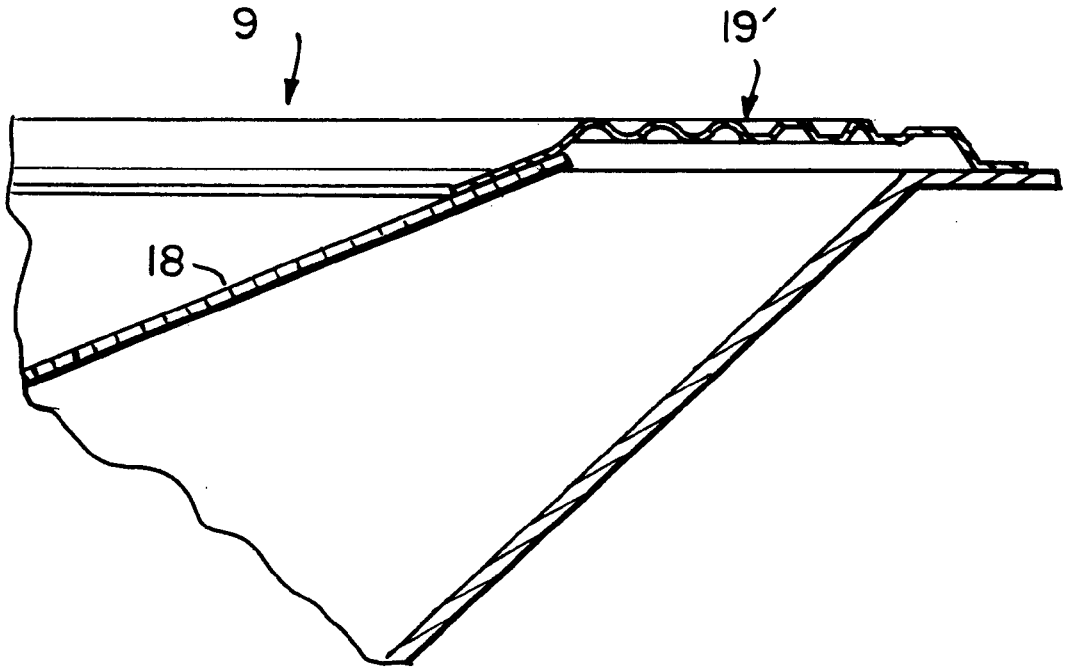

The regressive roll or regressive convolution configuration may also be employed on multi-roll loudspeaker cone 18 surrounds 19' as illustrated in FIG. 4.

The widths of the flats may also vary in some other way with increasing radius from the centerline of the coil former 16, or with increasing distance from the outer perimeter of the cone 18 in the case of a multi-roll surround 19'. For example, the widths of the flats may decrease with increasing radius from the centerline of the coil former 16 or with increasing distance from the outer perimeter of the cone, or the widths of the flats may vary in some other way, for example, quasi-randomly.

What is claimed is:

1. An electrodynamic transducer including a magnet assembly providing a magnetic field across an air gap, a voice coil, a coil former for supporting the voice coil in the air gap, a diaphragm having an apex, the coil former coupled to the apex so that current through the voice coil causing the voice coil to move in the air gap causes the diaphragm to move, and a spider coupled to the coil former to support the voice coil in the air gap, the spider having convolutions radially outward from the coil former, the convolutions including an arc and arcs being truncated.

2. The apparatus of claim 1 wherein the depth of the truncations is non-uniform with increasing distance from the coil former.

3. The apparatus of claim 2 wherein the depth of the truncations increases with increasing distance from the coil former.

4. The apparatus of claim 2 wherein the depth of the truncations varies quasi-randomly with increasing distance from the coil former.

5. An electrodynamic transducer including a magnet assembly providing a magnetic field across an air gap, a voice coil, a coil former for supporting the voice coil in the air gap, a diaphragm having an apex, the coil former coupled to the apex so that current through the voice coil causing the voice coil to move in the air gap causes the diaphragm to move, and a spider coupled to the coil former to support the voice coil in the air gap, the spider having convolutions radially outward from the coil former, the convolutions including an arc and the arcs being truncated.

6. The apparatus of claim 5 wherein the depth of the truncations is non-uniform with increasing distance from the coil former.

7. The apparatus of claim 6 wherein the depth of the truncations increases with increasing distance from the coil former.

8. The apparatus of claim 6 wherein the depth of the truncations varies quasi-randomly with increasing distance from the coil former.

9. An electrodynamic transducer including a frame, a magnet assembly providing a magnetic field across an air gap, a voice coil, a coil former for supporting the voice coil in the air gap, a diaphragm having an outer perimeter and an apex, the coil former coupled to the apex so that current through the voice coil causing the voice coil to move in the air gap causes the diaphragm to move, and a surround coupled to the outer perimeter and the frame to support the outer perimeter from the frame, the surround having convolutions radially outward from the outer perimeter, the convolutions including an arc and arcs being truncated.

10. The apparatus of claim 9 wherein the depth of the truncations is non-uniform with increasing distance from the outer perimeter.

11. The apparatus of claim 10 wherein the depth of the truncations increases with increasing distance from the outer perimeter.

12. The apparatus of claim 10 wherein the depth of the truncations varies quasi-randomly with increasing distance from the outer perimeter.

13. An electrodynamic transducer including a frame, a magnet assembly providing a magnetic field across an air gap, a voice coil, a coil former for supporting the voice coil in the air gap, a diaphragm having an outer perimeter and an apex, the coil former coupled to the apex so that current through the voice coil causing the voice coil to move in the air gap causes the diaphragm to move, and a surround coupled to the outer perimeter and the frame to support the outer perimeter from the frame, the surround having convolutions radially outward from the outer perimeter, the convolutions including an arc and arcs being truncated.

14. The apparatus of claim 13 wherein the depth of the truncations is non-uniform with increasing distance from the outer perimeter.

15. The apparatus of claim 14 wherein the depth of the truncations increases with increasing distance from the outer perimeter.

16. The apparatus of claim 14 wherein the depth of the truncations varies quasi-randomly with increasing distance from the outer perimeter.

* * * * *